US006280268B1

(12) United States Patent
Nishi et al.

(10) Patent No.: US 6,280,268 B1
(45) Date of Patent: Aug. 28, 2001

(54) TILT DEVICE FOR MARINE PROPULSION UNIT

(75) Inventors: Manabu Nishi; Hisao Takayanagi, both of Saitama (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/526,958

(22) Filed: Mar. 16, 2000

(30) Foreign Application Priority Data

Mar. 19, 1999 (JP) ..... 11-076789

(51) Int. Cl.[7] ..... B63H 5/125
(52) U.S. Cl. ..... 440/61
(58) Field of Search ..... 188/318, 275, 188/322.22; 440/61

(56) References Cited

U.S. PATENT DOCUMENTS 5,041,033 * 8/1991 Funami ..... 188/318
5,115,892 * 5/1992 Yamaoka et al. ..... 188/322.22
5,148,897 * 9/1992 Vanroye ..... 188/322.22

FOREIGN PATENT DOCUMENTS 86715 2/1996 (JP) .

* cited by examiner

*Primary Examiner*—Stephen Avila
(74) *Attorney, Agent, or Firm*—Orum & Roth

(57) ABSTRACT

A tilt device for a marine propulsion unit is disclosed where a shock blow valve comprises a disk valve fixed to a valve seat surface of the piston, the valve seat surface being provided with a seal member surrounding a communication hole which opens at the valve seat surface, and the disk valve is tightly connected to the seal member.

3 Claims, 11 Drawing Sheets

TILT DEVICE FOR MARINE PROPULSION UNIT

BACKGROUND OF THE INVENTION

1. Field of the Invention

The present invention relates to a tilt device for a marine propulsion unit.

2. Description of the Related Art

There exists a conventional tilt device for a marine propulsion unit in which a cylinder device is interposed between a stern bracket fixed to a boat body and a swivel bracket which supports a propulsion unit. An interior of the cylinder device is divided into a first tilt chamber closer to a side in which a piston rod is accommodated and a second tilt chamber closer to a side in which the piston rod is not accommodated by means of a piston. The tilt device includes a shock blow valve which makes it possible to expand the piston rod by sending oil in the first tilt chamber to the second tilt chamber through a communication hole formed in the piston which is opened and closed with a constant set pressure. In this prior art, when the marine propulsion unit collides against a floating log or the like, the shock blow valve is opened to turn up the propulsion unit, thereby absorbing the impact force.

In the prior art, the shock blow valve comprises a ball for sitting on a valve seat provided around the communication hole of the piston thereby closing the communication hole, and a spring for biasing the ball against the valve seat. The prior art has the following problems 1) to 3).

1) In the case of the shock blow valve using the ball, it takes time to completely close the communication hole after the hole is once opened, and the response is slow. This is because it takes time to obtain a sitting attitude of the ball, having critical clearance tolerances, with the result that the ball completely conforms to the valve seat with difficulty.

2) The setting of the valve opening pressure is difficult due to variation of the spring constant.

3) The ball and the spring occupy constant space in a thickness direction of the piston, and this fact increases the thickness of the piston. As a result, even if the cylinder's length is the same, a piston stroke in the cylinder is shortened.

SUMMARY OF THE INVENTION

It is an object of the present invention to quicken the response of a shock hollow valve of a tilt device for a marine propulsion unit, to facilitate fine adjustment of valve opening pressure, to reduce thickness of a piston, and to increase a piston stroke in a cylinder having the same length as much as possible.

According to the present invention, there is disclosed a tilt device for a marine propulsion unit in which a cylinder device is interposed between a stern bracket fixed to a boat body and a swivel bracket which supports a propulsion unit. The cylinder device is divided into a first tilt chamber closer to a side in which a piston rod is accommodated and a second tilt chamber closer to a side in which the piston rod is not accommodated by means of a piston fixed to the piston rod. The tilt device includes a shock blow valve which makes it possible to expand the piston rod by sending oil in the first tilt chamber to the second tilt chamber through a communication hole formed in the piston which is opened and closed with a constant set pressure. The shock blow valve comprises a disk valve fixed to a valve seat surface of the piston, the valve seat surface being provided with a seal member surrounding a communication hole which opens at the valve seat surface. The disk valve is tightly connected to the seal member.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

FIGS. 8 and 9 show a seal member provided on a piston, wherein FIG. 8 is a sectional view of the entire seal member, and FIG. 9 is a sectional view of an essential portion of the seal member;

FIGS. 10 to 12 show the seal member provided on the piston, wherein FIG. 10 is a plan view of the entire seal member, FIG. 11 is a plan view of an essential portion of the seal member, and FIG. 12 is a sectional view taken along the line C—C;

FIGS. 13 and 14 show a seal member provided on a piston in a shock blow valve of a second embodiment, wherein FIG. 13 is a sectional view of the entire seal member, and FIG. 14 is a sectional view of an essential portion of the seal member; and FIGS. 15 to 17 show the seal member provided on the piston, wherein FIG. 15 is a plan view of the entire seal member, FIG. 16 is a plan view of an essential portion of the seal member, and FIG. 17 is a sectional view taken along the line C—C.

DESCRIPTION OF THE PREFERRED EMBODIMENTS

Figure 1:
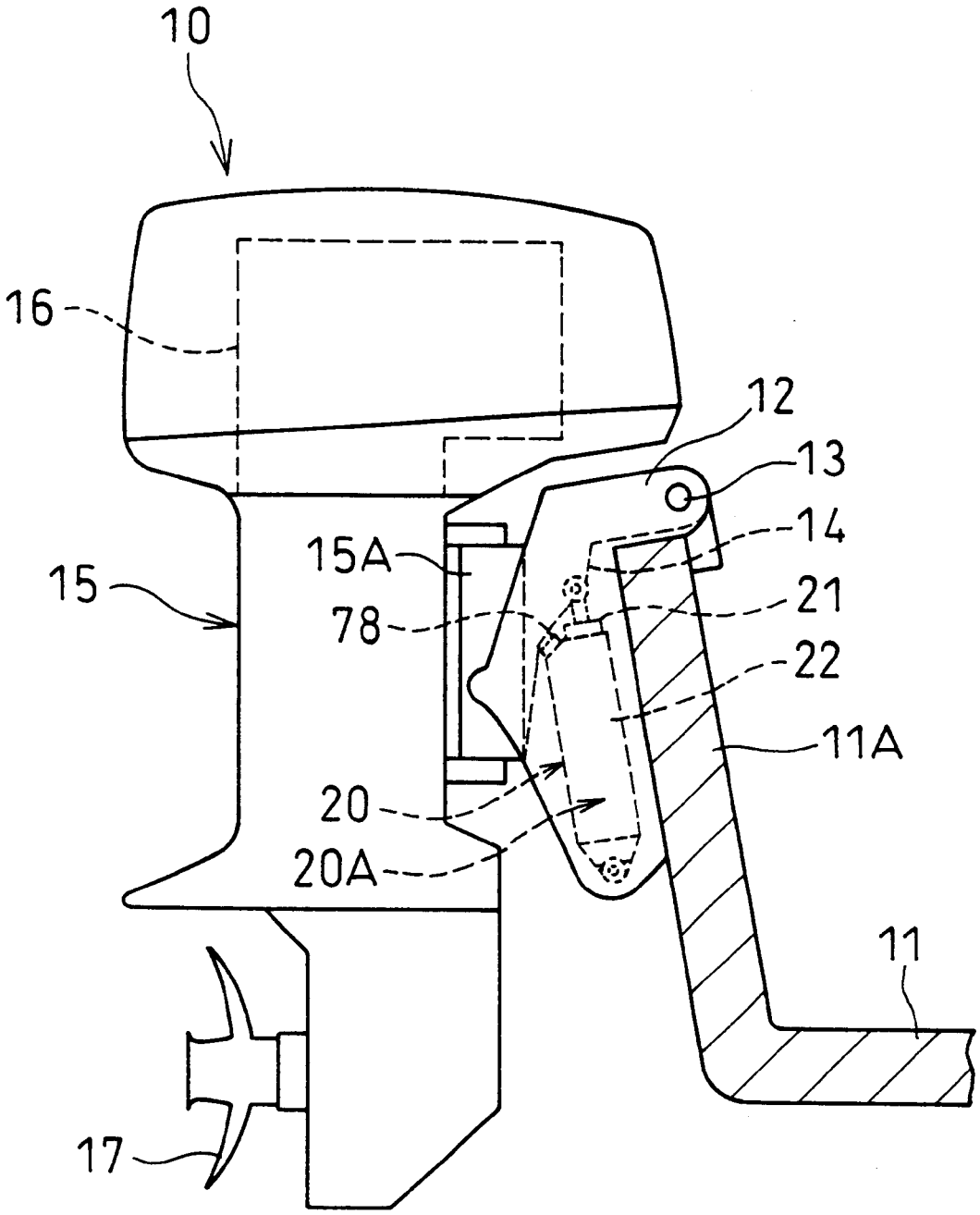
FIG. 1 is a schematic view showing a marine propulsion unit.
Figure 2:
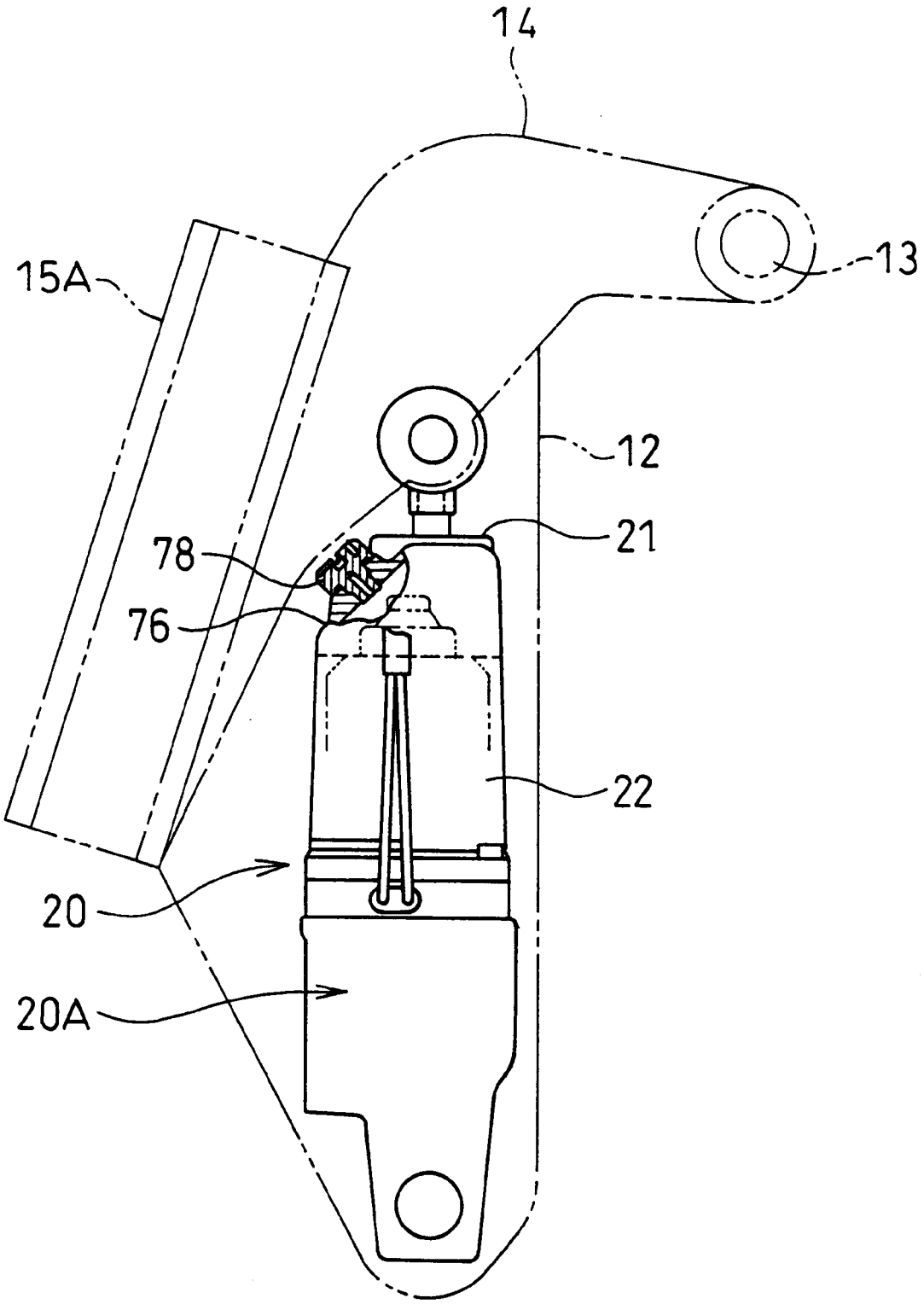
FIG. 2 is a side view showing a layout of a stern bracket, a swivel bracket and a power unit.
Figure 3:
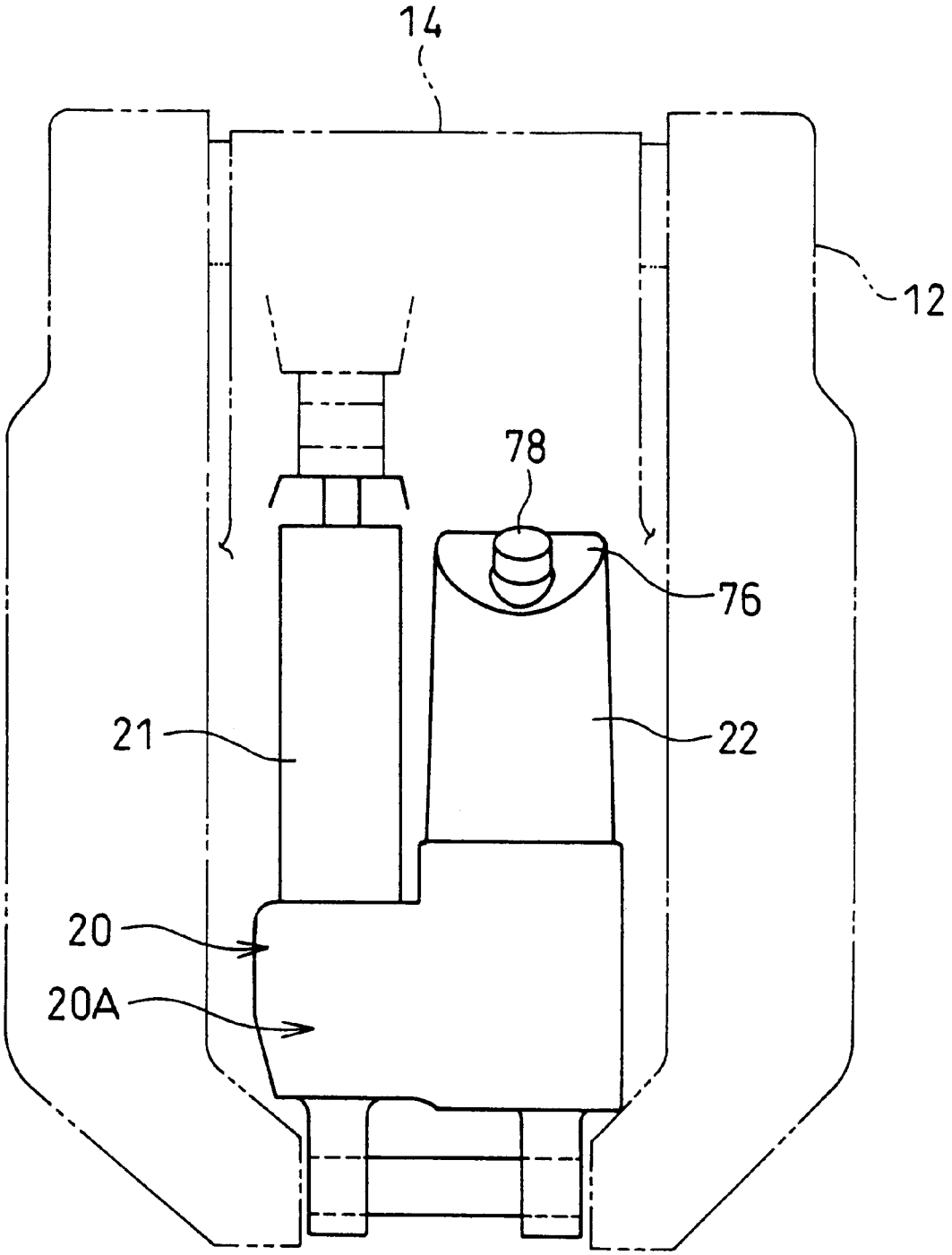
FIG. 3 is a front view showing the layout of the stern bracket, the swivel bracket and the power unit.

As shown in FIG. 1 to FIG. 3, a marine propulsion unit 10 (it may be an outboard motor or an inboard motor) is provided with a stern bracket 12 secured to a stern plate 11A of a boat body 11. And a swivel bracket 14 is pivotally connected to the stern bracket 12 through a tilt shaft 13 such that the swivel bracket 14 can tilt around a substantially horizontal axis. A propelling unit 15 is pivotally connected to a swivel bracket 14 through a steering shaft which is not shown and is substantially vertically disposed such that the propelling unit 15 can be turned around the steering shaft. An engine unit 16 is mounted in an upper portion of the propelling unit 15, and the propelling unit 15 is provided at its lower portion with a propeller 17.

The propelling unit 15 of the marine propulsion unit 10 is pivotally supported on the stern bracket 12 secured to the boat body 11 through the tilt shaft 13 and the swivel bracket 14. A cylindrical device 21 of a power unit 20A constituting the tilt device 20 is interposed between the stern bracket 12 and the swivel bracket 14. And a hydraulic fluid is selectively supplied or discharged from or into a hydraulic fluid supply/discharge device 22 of the power unit 20A into or from the cylinder device 21, thereby expanding or contracting the cylinder device 21 so that propelling unit 15 can be tilted.

Figure 4:
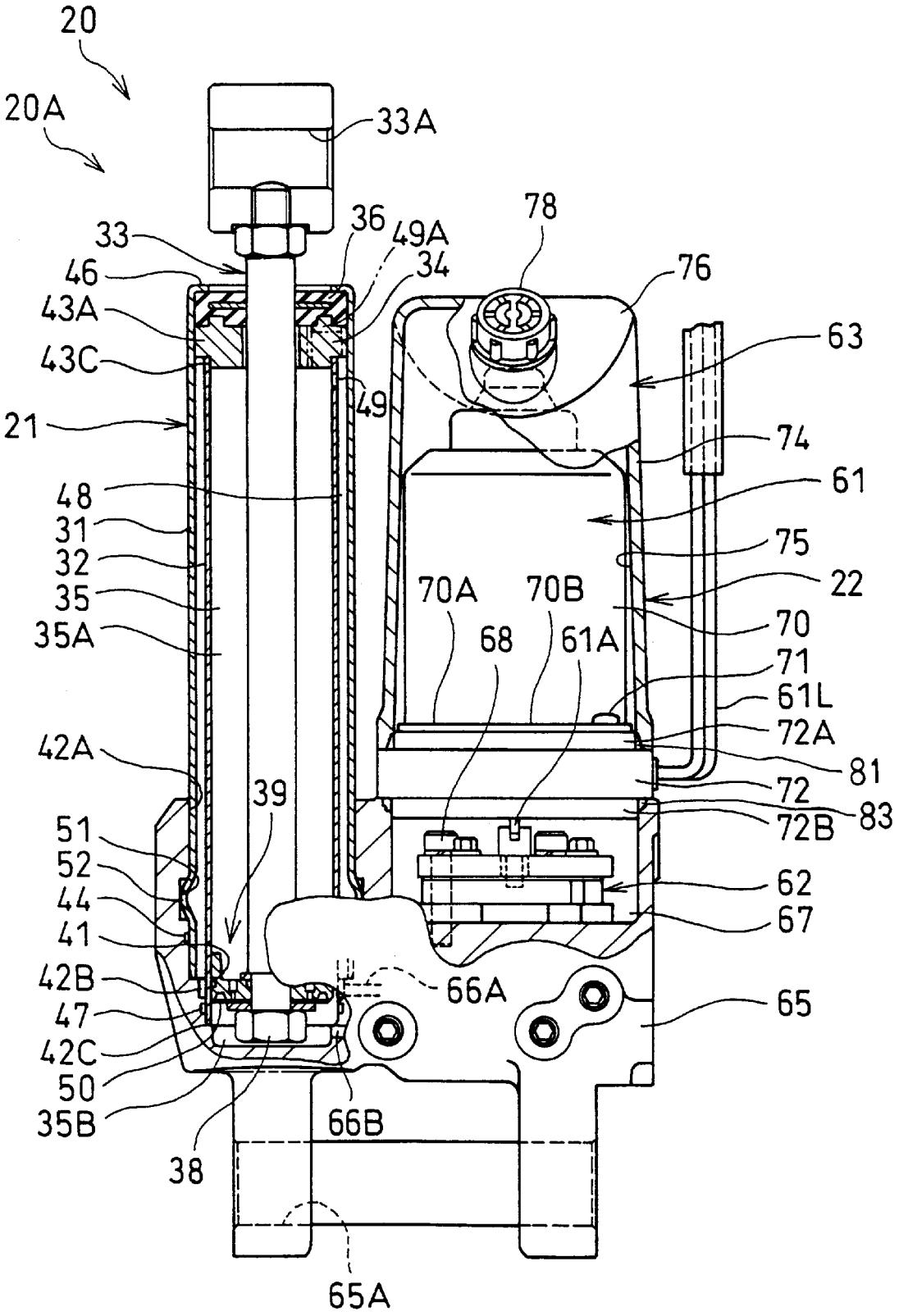
FIG. 4 is a front view, partly in section, of the power unit.

(Cylinder device 21) (FIG. 4)

The cylinder device 21 of the power unit 20A constituting the tilt device 20 is integrally coupled to a valve block 65, which will be described later, in a hydraulic fluid supply/discharge device 22. The cylinder device 21 includes an outer cylinder 31 and an inner cylinder 32 which may be steel pipes formed by drawing molding. These cylinders 31 and 32 are integrally coupled to the valve block 65. The valve block 65, which may be a cast aluminum alloy for example, includes a mounting pin insertion hole 65A for the stern bracket 12.

The cylinder device 21 includes a piston rod 33 which is connected to the swivel bracket 14. The piston rod 33 is inserted through a rod guide 34 provided at an open end of the outer cylinder 31 and into a tilt chamber 35 of the inner cylinder 32 such that the piston rod 33 can be extended and contracted. The rod guide 34 includes a seal member 36 which slidably engages the piston rod 33. The piston rod 33 includes a mounting pin insertion hole 33A for the swivel bracket 14.

Cylinder device 21 includes a piston 39 secured to an end of the piston rod 33 in the tilt chamber 35 of the inner cylindrical 32 by a nut 38. The piston 39 includes a seal member 41 such as an O-ring or the like which is slidably in contact with the inner surface of the inner cylinder 32, and divides the tilt chamber 35 into a first tilt chamber 35A which accommodates the piston rod 33 and a second tilt chamber 35B which does not accommodate the piston rod 33.

The cylinder device 21 includes a large diameter hole 42A, an intermediate diameter hole 42B and a small diameter hole 42C which are concentric with the valve block 65, and a large diameter portion 43A and a small diameter portion 43C which are concentric with the rod guide 34. One end of the outer cylinder 31 is fitted to the large diameter hole 42A of the valve block 65 through a seal member 44 such as an O-ring, and the other end of the outer cylinder 31 is fitted to the large diameter portion 43A of the rod guide 34 and is secured by a bent portion 46. One end of the inner cylinder 32 is fitted to the small diameter hole 42C of the valve block 65 through a seal member 47 such as an O-ring, and the other end of the inner cylinder 32 is fitted to and secured to the small diameter portion 43C of the rod guide 34. With this structure, a ring space-like oil passage 48 is formed between the outer cylinder 31 and the inner cylinder 32, and the first tilt chamber 35A and the oil passage 48 are interconnected through an oil passage 49 which opens at the inner cylinder 32 (or a communicating passage 49A which opens at the rod guige 34). The oil passage 48 which is in communication with the first tilt chamber 35A interconnects with a first oil passage 66A which is in communication with the intermediate diameter hole 42B of the valve block 65, and the second tilt chamber 35B is connected with a second oil passage 66B provided in the valve block 65 respectively.

The piston 39 of the cylinder device 21 includes a shock blow valve 50 which opens at a set pressure to protect a hydraulic pressure circuit when an impact force is applied in an extension direction of the cylinder device 21, such as when a floating log collides against the propelling unit 15. The hydraulic fluid in the first tilt chamber 35A is transferred to the second tilt chamber 35B so that the piston rod 33 can be extended.

Next, a structure for coupling the cylinder device 21 to the valve block 65 will be explained.

(1) The large diameter hole 42A of the valve block 65 is provided with a ring groove 51 having an arc or square section. One end of the outer cylinder 31 is inserted into the large diameter hole 42A, one end of the outer cylinder 31 being bulged or distended outwardly by a bulge process to form a bulge portion 52, the bulge portion 52 being engaged with the above-described ring groove 51. The bulge process is conducted, for example, by pressing a resilient member such as a urethane insert into the outer cylinder 31 by the pressuring piston (this can also be done by pressing a liquid charged in the outer cylinder 31, or by enlarging a diameter of a division ring inserted in the outer cylinder 31), so that the outer cylinder 31 is deformed or distended to follow the ring groove 51 of a valve block 65.

(2) An assembly of the inner cylinder 32 is inserted into the outer cylinder 31 which is secured to the valve block 65 by the above process (1), and one end of the inner cylinder 32 is fitted to the small diameter hole 42C of the valve block 65. The assembly of the inner cylinder 32 comprises the piston 39, the piston rod 33, and the rod guide 34 or the like, which have been previously assembled into the inner cylinder 32 before the inner cylinder 32 is inserted into the outer cylinder 31.

(3) A bent portion 46 at the other end of the outer cylinder 31 is secured around the rod guide 34 of the assembly of the inner cylinder 32.

Figure 5:
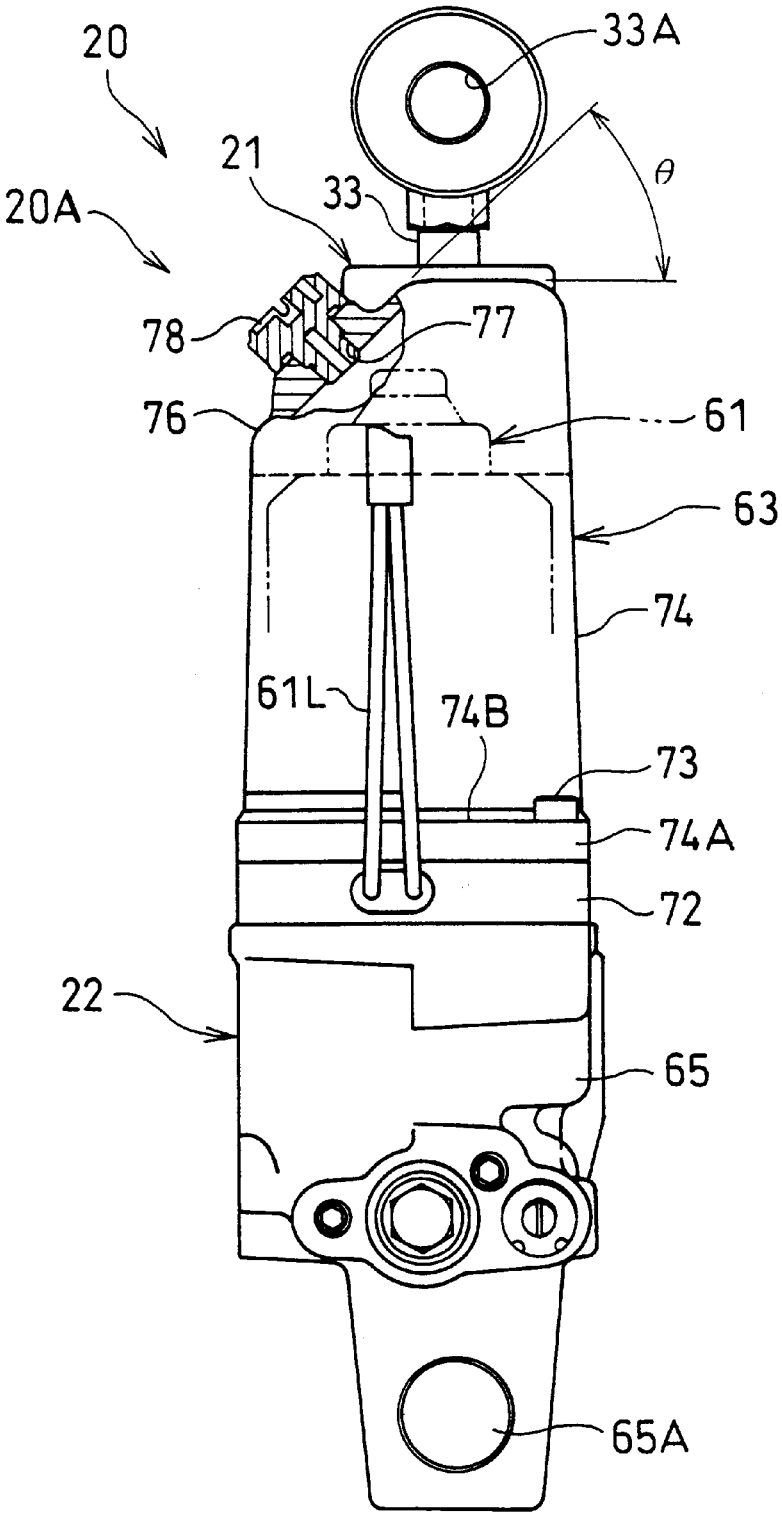
FIG. 5 is a side view of FIG. 4.
Figure 6:
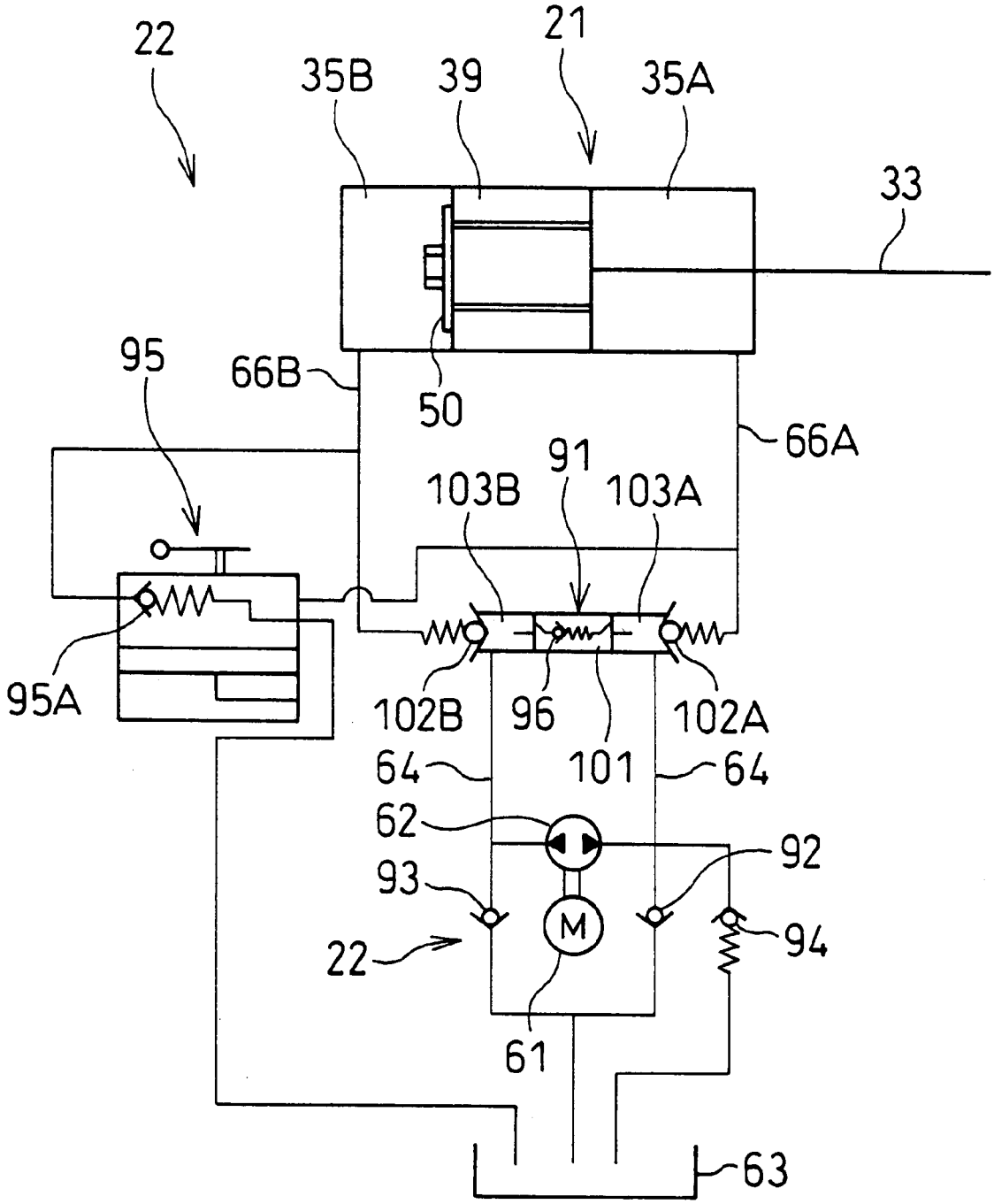
FIG. 6 is a circuit diagram showing a hydraulic pressure circuit.
Figure 7:
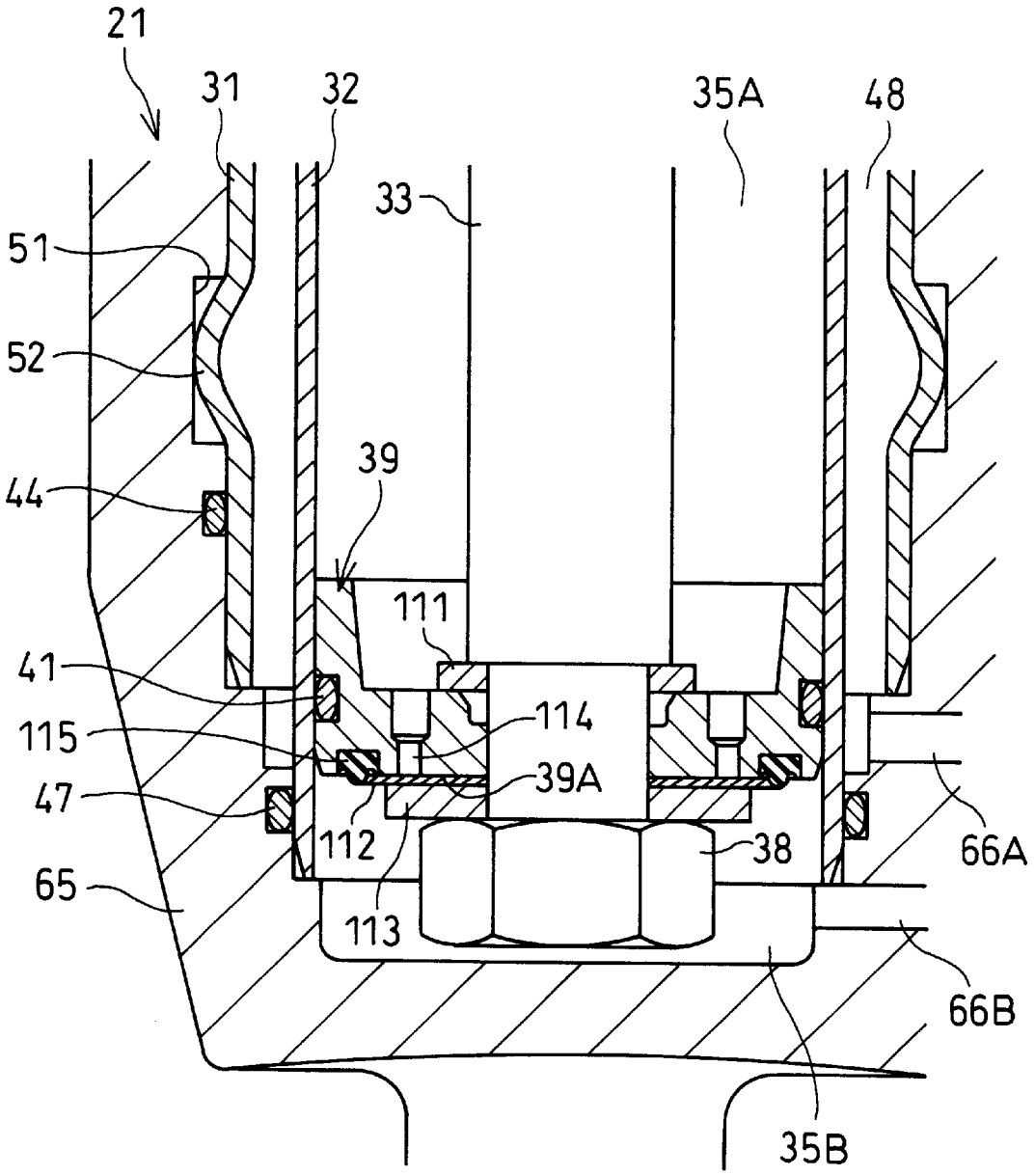
FIG. 7 is a sectional view showing a shock blow valve of a first embodiment.

The Hydraulic fluid supply/discharge device 22, as shown in FIGS. 4 and 5, is next described.

The hydraulic fluid supply/discharge device 22 of the power unit 20A constituting the tilt device 20 comprises a reversible motor 61, a reversible gear pump 62 and a tank 63, and a switching valve 64, which can supply and discharge a hydraulic fluid to and from the first tilt chamber 35A and the second tilt chamber 35B of the cylinder 21 through the first oil passage 66A and the second oil passage 66B provided in the valve block 65.

At that time, the hydraulic fluid supply/discharge device 22 forms a passage having a switch valve 64 on the valve block 65 formed of cast aluminum alloy, and includes the first oil passage 66A, and the second oil passage 66B. The valve block 65 includes a large diameter block 42A, an intermediate diameter hole 42B and a small diameter hole 42C for integrally forming the cylinder device 21 as described above, and includes a pump chamber 67 at a location adjacent to an integrally coupled portion of the cylinder device 21. The pump chamber 67 accommodates the hydraulic fluid, and includes the pump 62 in a state where the pump 62 soaks in the hydraulic fluid. The pump 62 is secured to the valve block 65 through a bolt 68.

The hydraulic fluid supply/discharge device 22 includes a motor 61 which drives the pump 62 and which is disposed on an upper portion of the pump chamber 67 provided in the valve block 65, and the tank 63 comprises a tank housing 74 for covering the motor 61. The motor 61 comprises an iron yoke 70, and an end plate 72 connected in a water-tight manner to a lower opening end of the yoke 70 through a seal member such as an O-ring, which is secured thereto by a setscrew. The end plate 72 is provided at its upper and lower sides with upper and lower steps 72A and 72B, respectively. A periphery portion of the pump chamber 67 of the valve block 65 is fitted to the lower step 72B and is connected in a water-tight manner with an O-ring 83. The tank bushing 74 is fitted to the upper step 72A and is connected in a water-tight manner with an O-ring 81. The tank housing 74 and the end plate 72 are fastened to the valve block 65 by a bolt 73. Details thereof are described below.

The hydraulic fluid supply/discharge device 22 secures mounting portions 70B for mounting a seat 70A of the iron yoke 70 of the motor 61 to an end plate 72, which may be made of synthetic resin, for the motor 61, by setscrews 71. A lead wire 61L of the motor 61 is pulled out from a side of the end plate 72. The end plate 72 of the motor 61 is secured around the pump chamber 67 of the valve block 65 together with the mounting portion 74B of the mounting seat 74A of the tank housing 74 by a bolt 73, to seal the pump chamber 67. An output shaft 61A of the motor 61 is passed through the end plate 72 in a water-tight manner and is connected to a follower shaft of the pump 62.

The hydraulic fluid supply/discharge device 22 covers the yoke 70 of the motor 61 with the tank housing 74 which may be made of synthetic resin and having a cylindrical shape and may have a ceiling corresponding to the outline of the yoke 70 of the motor 61. The tank housing 74 is secured to the valve block 65 together with the end plate 72 of the motor 61 by the bolt 73 to constitute the tank 63. A space between the tank housing 74 and the yoke 70 of the motor 61 is defined as the tank chamber 75.

In the tilt device 20, as shown in FIGS. 1 to 3, when the power unit 20A is interposed between the stern bracket 12 and the swivel bracket 14 as described above, as shown in FIGS. 4 and 5, a chamfered portion 76 is formed on an upper portion of the tank housing 74 of the tank 63 constituting the power unit 20A, the chamfered portion 76 being formed on the upper portion of the tank housing 74 on the side facing the swivel bracket 14. The chamfered portion 76 is provided with an oil pouring hole 77, and a cap 78 is mounted to the oil poring hole 77. A chamfering angle θ of the chamfered portion 76 with respect to an upper surface of the tank housing 74 is 45°, for example.

The hydraulic fluid supply/discharge device 22 further includes a shuttle type switch valve 91, check valves 92, 93, a contraction-side relief valve 94, a manual-thermal valve 95 and an extension-side relief valve 96.

The shuttle type switch valve 91 includes a shuttle piston 101, and first and second check valves 102A and 102B disposed on opposite sides of the shuttle piston 101. A first shuttle chamber 103A is defined in the shuttle piston 101 at the side of the first check valve 102A, and a second shuttle chamber 103B is defined in the shuttle piston 101 at the side of the second check valve 102B. The first check valve 102B is opened by hydraulic pressure applied to the first shuttle chamber 103A, by the normal rotation of the pump 62, through a pipe 64, and the second check valve 102B is opened by hydraulic pressure applied to the second shuttle chamber 103B, by the reverse rotation of the pump 62, through a pipe 64. The shuttle piston 101 opens the second check valve 102B by hydraulic pressure by the normal rotation of the pump 62, and opens the first check valve 102A by the hydraulic pressure by the reverse rotation of the pump 62. The first check valve 102A of the shuttle type switch valve 101 is connected to the first oil passage 66A, and the second check valve 102B is connected to the second oil passage 66B.

A check valve 92 is interposed in an intermediate portion of a connection pipe connecting the pump 62 and the tank 63. More specifically, during tilt up operation of the marine propulsion device 10, the volume in the cylinder 32 is increased by a displaced volume of the retreated piston rod 33 and an amount of circulating hydraulic fluid which is running short. Therefore, the check valve 92 is opened so that the deficiency can be compensated to the pump 62 from the tank 63.

A check valve 93 is interposed in an intermediate portion of a connection pipe connecting the pump 62 and the tank 63. More specifically, during the tilt down operation of the marine propulsion device 10, when the piston 39 reaches the maximum contraction position, the tilt down operation has been completed, and there is no hydraulic fluid returning from the second tilt chamber 35B to the pump 62, if the pump 62 is further operated, the check valve 93 is opened so that hydraulic fluid can be supplied from the tank 63 to the pump 62.

The contraction-side relief valve 94 is connected to the pipe 64. In order to return to the tank 63, the hydraulic fluid for the rod which remains at the time of the tilt down operation, and in order to protect the hydraulic circuit when the pump 62 is further operated even if the tilt down operations have been completed, the pressure in the circuit is released to the tank 63 if the pressure reaches a set pressure.

An extending-side relief valve 96 is embedded in a shuttle piston 101 for releasing circuit pressure toward a pump suction side at a set pressure so as to protect the hydraulic pressure circuit when the pump 62 continues to be operated after the tilting up operation is completed.

Where the manual-thermal valve 95 is connected to the second oil passage 66B, the cylinder device 21 may be manually contracted by connecting the second-tilt chamber 35B to the tank 63, so that the propulsion unit 15 can trim down and tilt down. The manual-thermal valve 95 includes a thermal relieve valve 95A so that when pressure in the hydraulic fluid of the cylinder 21 is abnormally increased due to a heat, the pressure in the circuit is released to the tank 63 if the pressure reaches a set pressure.

The basic operation of the tilt device 20 will be explained below.

(1) Tilt down

When the motor 61 and the pump 62 are normally rotated, the discharged oil from the pump 62 opens the first check valve 102A of the shuttle type switch valve 91, and also opens the second check valve 102B through the shuttle piston 101. In this mode of operation, the discharged oil from the pump 62 passes through the first check valve 102A and the first oil passage 66A and is supplied into the first tilt chamber 35A of the cylinder device 21. The hydraulic fluid in the second tilt chamber 35B of the cylinder device 21 passes through the second oil passage 66B of the second check valve 102B and returns to the pump 62 to contract the cylinder device 21 so that the cylinder device 21 is tilted down.

(2) Tilt up

When the motor 61 and the pump 62 are rotated in reverse, the discharged oil from the pump 62 opens the second check valve 102B of the shuttle type switch valve 91, and also opens the first check valve 102A through the shuttle piston 101. In this mode of operation, the discharged oil from the pump 62 passes through the second check valve 102B and the second oil passage 66B and is supplied to the second tilt chamber 35B of the cylinder device 21, and the hydraulic fluid in the first tilt chamber 35A of the cylinder device 21 passes through the first oil passage 66A and the first check valve 102A and returns to the pump 62 to expand the cylinder device 21 so that the cylinder device 21 is tilted up.

(3) When the marine propulsion unit collides against a floating log or the like, and the propulsion unit 15 of the marine propulsion unit 10 collides against the obstacle during forward running, pressure in the first tilt chamber 35A is abnormally increased due to the impact force so that the shock blow valve 50 is opened, the oil in the first tilt chamber 35A is sent to the second tilt chamber 35B, the piston rod 33 extends with respect to the cylinder 32, and the propulsion unit 15 is turned up, thereby absorbing the impact.

The First Embodiment, as shown in FIGS. 7 to 12, is next disclosed.

In the cylinder device 21 of the tilt device 20, the shock blow valve 50 is structural in the following manner. As shown in FIGS. 7 to 9C, in the cylinder device 21, a washer 111, the piston 39, a disk valve 112 and a valve stopper 113 are sandwiched between the end of the piston rod 33 and a nut 38. The disk valve 112 fixed to a valve seat surface 39A of the piston 39 constitutes the shock blow valve 50. A seal member 115 is provided such as to surround the communication hole 114 between the first chamber 35A and the second tilt chamber 35B, and the disk valve 112 is tightly connected to the seal member 115. With this arrangement, the shock blow valve 50 opens and closes the communication hole 114 at a given set pressure determined by the number of laminated layers of the disk valve 112, or by a diameter of the valve stopper 113, so that the oil in the first tilt chamber 35A is sent to the second tilt chamber 35B, thereby allowing the piston rod 33 to extend.

Figure 8:
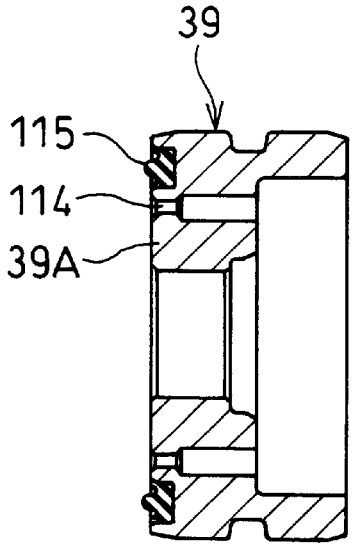
Figure 10:
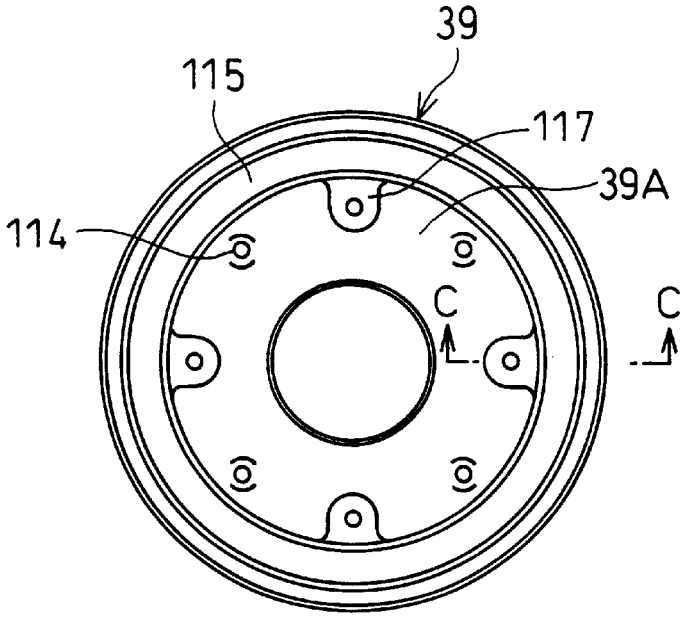
Figure 11:
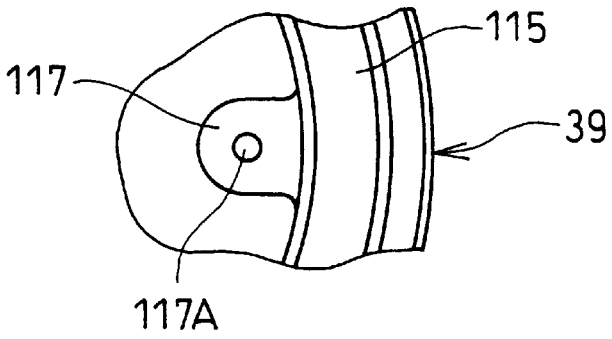
Figure 12:
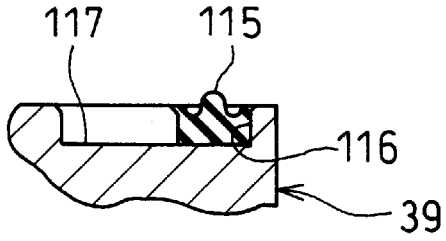

In one embodiment, the piston 39 includes a plurality of communication holes 114, and a single annular seat member 115 which collectively surround all of the communication holes 114 (FIGS. 8 and 10). The valve seat surface 39A of the piston 39 is formed with a single annular holding groove 116 of the seal member 115. An injection forming flowing groove 117 is formed in each of a plurality of positions of an inner periphery of the holding groove 116 in its circumferential direction (FIGS. 10 to 12). With this arrangement, an injection mold (not shown) is put on the valve seat surface 39A of the piston 39, an injection nozzle of the mold is fitted to the flowing groove 117, and in this state, molten material such as rubber is allowed to flow into the holding groove 116, thereby baking and adhering the seal member 115 to the holding groove 116 (cure adhesion by injection). In FIGS. 10 and 11, the symbol 117A represents a nozzle hole mark (trace) of the injection nozzle.

Figure 9:
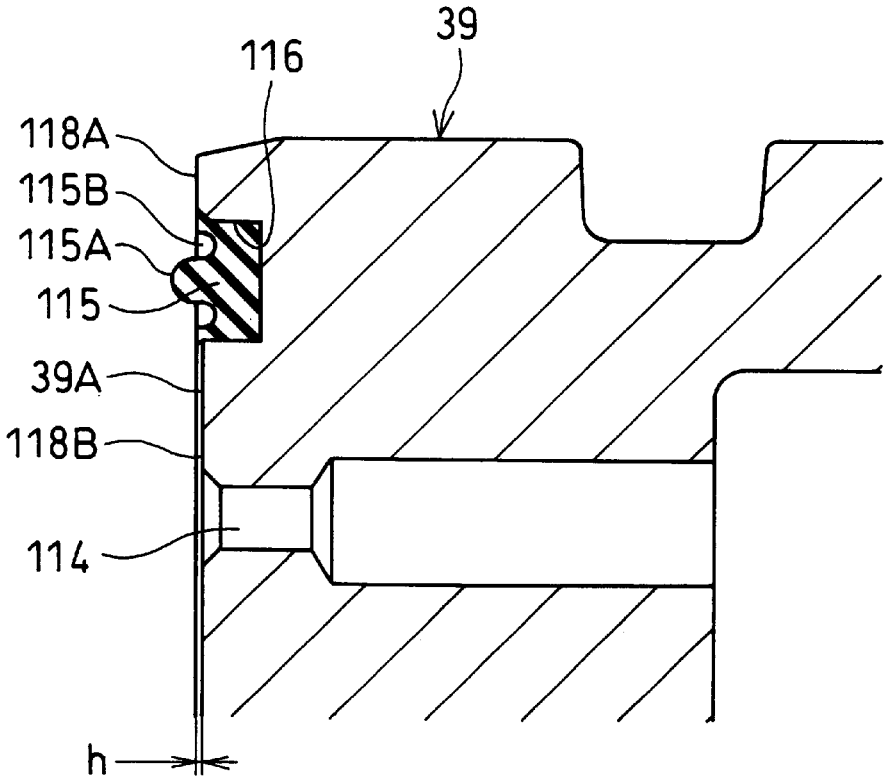

In the shock blow valve 50, as shown in FIG. 9, an outer peripheral portion 118 of the valve seat surface 39A of the piston 39 is formed slightly higher than an inner peripheral portion 118B (step h) so that a preset load is applied to the disk valve 112. With this arrangement, the disk valve 112 is bent and mounted upon the valve seat surface 39A of the piston 39 to apply the preset load. If the preset load is applied to the disk valve 112, the response speed thereof from the time when the valve 112 is first opened to the time when the valve is closed is high, so that the response can be further quickened.

The seal member 115 formed in the holding groove 116 provided in the valve seat surface 39A of the piston 39 is formed such that in the holding groove 116 of rectangular cross section, a central portion of the seal member 115 is formed with a projection 115A, and opposite sides of the projection 115A are formed with recesses 115B and 115B.

Therefore, the following effect can be obtained by the present embodiment.

1) The valve seat surface 39A of the piston 39 is provided with the seal member 115, and the disk valve 112 constituting the shock blow valve 50 is tightly connected to the seal member 115. With this arrangement, the shock blow valve 50 is tightly closed immediately when the disk valve 112 is brought into contact with the seal member 115. The response speed thereof from the time when the valve 112 is once opened to the time when the valve is closed is shortly, so that the response can be further quickened.

2) A valve opening pressure of the shock blow valve 50 can be adjusted by the number of laminated layers of the disk valve 112 fixed to the valve seat surface 39A of the piston 39, and the valve opening pressure can thereby be set finely. The valve opening pressure can also be adjusted by varying the diameter of the valve stopper 113.

3) The space occupied by the disk valve 112 and the seal member 115 constituting the shock blow valve 50 in the thickness direction of the piston 39 may be small, the thickness of the piston 39 may be reduced, and the piston stroke can be increased to the utmost in the cylinder having the same length, as much as possible. Further, if the piston stroke is the same, it is possible to shorten the length of the cylinder, and the cylinder can be made compact.

4) Of the disk valve 112 and the seal member 115 constituting the shock blow valve 50, when the seal member 115 is formed integrally with the valve seat surface 39A of the piston 39 by the adhesive, it is possible to reduce the number of parts of the assembly and the number of assembling steps.

5) When the shock blow valve 50 includes the single seal members 115 which collectively surround all the communication holes 114, the pressure receiving area of the disk valve 112 divided by the seal member 115 is increased, the valve can be opened with relatively low pressure, and the valve opening pressure can be reduced.

6) Where the shock blow valve 50 is constituted such that the seal member 115 is adhered to the holding groove 116 formed in the valve seat surface 39A of the piston 39, it is possible to reduce the number of parts of the assembly and the number of assembling steps.

7) Where the shock blow valve 50 is constituted such that the seal member 115 is injection molded to the holding groove 116 formed in the valve seat surface 39A of the piston 39, it is possible to reduce the number of parts of the assembly and the number of assembling steps.

The Second Embodiment, as shown in FIGS. 13 to 17, is next described.

In the second embodiment also, like the first embodiment, the shock blow valve 50 is constituted by the disk valve 112 being fixed to the valve seat surface 39A of the piston 39, the seal member 121 being arranged to surround the communication hole 114 opening at the valve seat surface 39A, and the disk valve 112, is arranged to tightly connect to the seal member 121. With this arrangement, the shock blow valve 50 opens and closes the communication hole 114 at a given set pressure determined by the number of laminated layers of the disk valve 112, or by a diameter of the valve stopper 113, so that the oil in the first tilt chamber 35A is sent to the second tilt chamber 35B, thereby allowing the piston rod 33 to extend.

Figure 13:
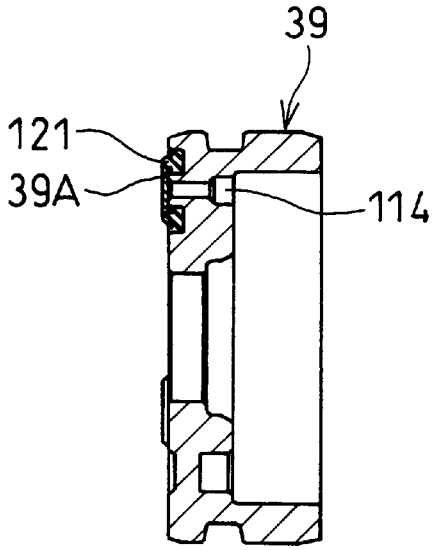
Figure 14:
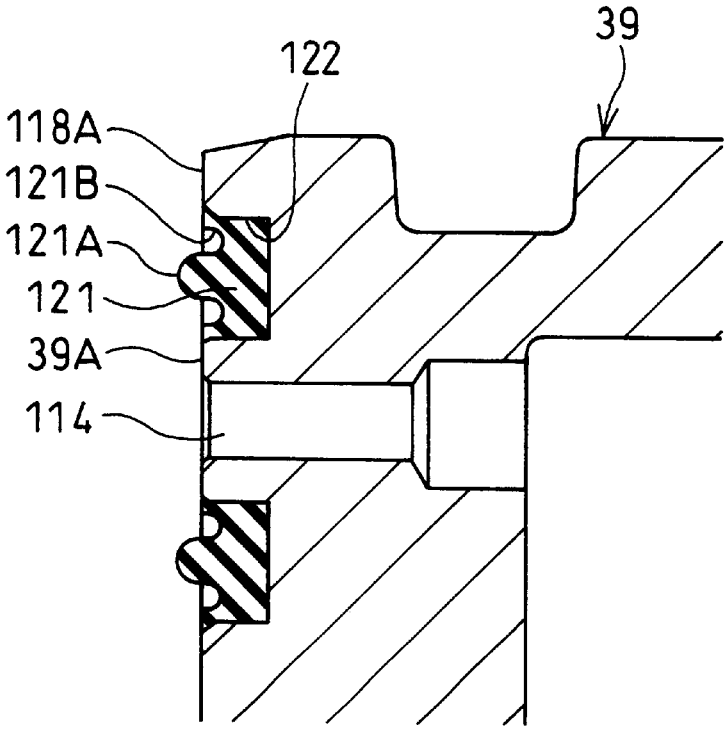
Figure 15:
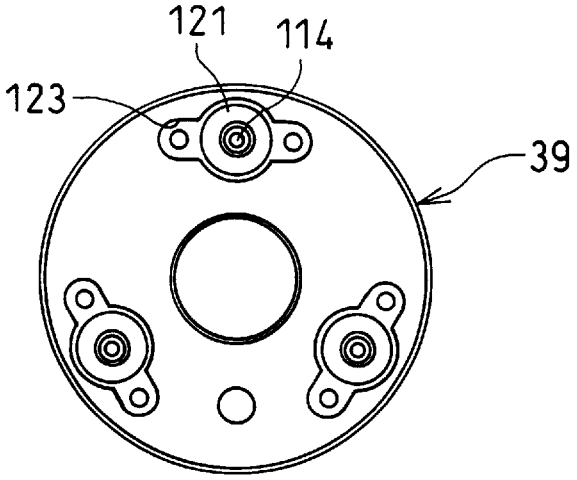
Figure 16:
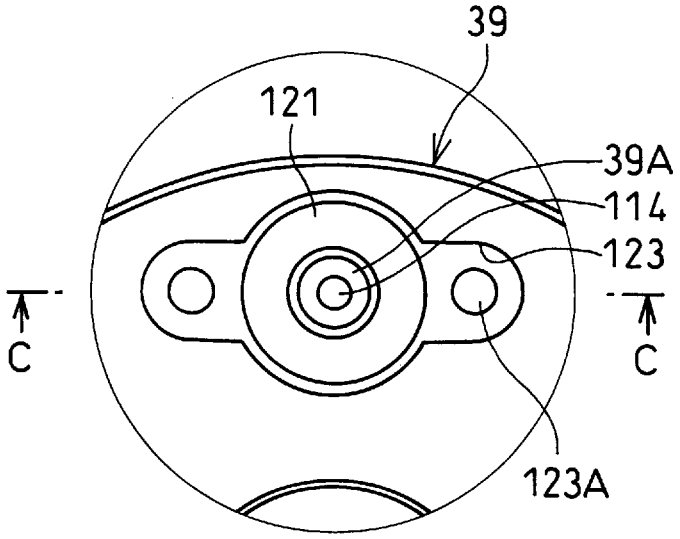
Figure 17:
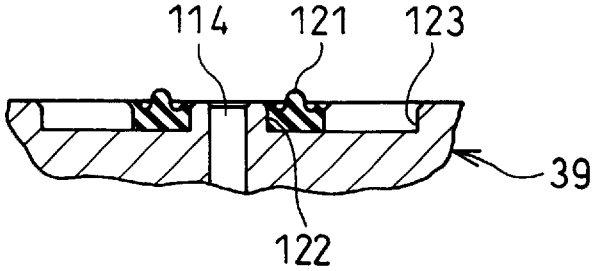

At that time, the piston 39 includes a plurality of communication holes 114, and includes small annular seal members 121 each surrounding each of the communication holes 114 (FIGS. 13, 15 and 16). Annular holding grooves 122 are formed in the valve seat surface 39A of the piston 39 around each of the communication holes 114, and injection forming flowing groove 123 is auxiliary formed in a side of each of the holding grooves 122 (two locations in the diametric direction) (FIGS. 16 and 17). With this arrangement, an injection mold (not shown) is put on the valve seat surface 39A of the piston 39, an injection nozzle of the mold is fitted to the flowing groove 123, and in this state, molten material such as rubber is allowed to flow into the holding groove 122, thereby baking and adhering the seal member 121 to the holding groove 122 (cure adhesion by injection). In FIGS. 15 and 16, the symbol 123A represents a nozzle hole mark (trace).

The seal member 121 formed in the holding groove 122 provided in the valve seat surface 39A of the piston 39 is formed such that in the holding groove 122 of rectangular cross section, a central portion of the seal member 121 is formed with a projection 121A, and opposite sides of the projection 121A are formed with recesses 121B and 121B.

According to the present embodiment, the same effects as 1) to 4), 6) and 7) in the first embodiment can be obtained.

As heretofore explained, embodiments of the present invention have been described in detail with reference to the drawings. However, the specific configurations of the present invention are not limited to the embodiments but those having a modification of the design within the range of the present invention are also included in the present invention.

According to the present invention, in a shock blow valve of a tilt device for a marine propulsion unit, it is possible to quicken response of the valve, to finely set valve opening pressure, to reduce thickness of a piston, and to increase a piston stroke in a cylinder having the same length, as much as possible. Alternatively, if the piston stroke is the same, it is possible to shorten the length of the cylinder, and the cylinder can be made compact.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A tilt device for a marine propulsion unit in which a cylinder device is interposed between a stern bracket fixed to a boat body and a swivel bracket which supports a propulsion unit, the cylinder device is divided into a first tilt chamber closer to a side in which a piston rod is accommodated and a second tilt chamber closer to a side in which the piston rod is not accommodated by means of a piston fixed to a piston rod, and the tilt device includes a shock blow valve which makes it possible to expand the piston rod by sending oil in the first tilt chamber to the second tilt chamber through a communication hole formed in the piston which is opened and closed with a constant set pressure, wherein the shock blow valve comprises a disk valve fixed to a valve seat surface of the piston, the valve seat surface is provided with a seal member surrounding a communication hole which opens at the valve seat surface, and the disk valve is tightly connected to the seal member;

a holding groove of the seal member is formed in the valve seat surface of the piston, and the seal member is adhered to the holding groove;

the holding groove formed in the valve seat surface of the piston auxiliary includes a flowing groove for inject-forming the seal member.

2. A tilt device for a marine propulsion unit in which a cylinder device is interposed between a stern bracket fixed to a boat body and a swivel bracket which supports a propulsion unit, the cylinder device is divided into a first tilt chamber closer to a side in which a piston rod is accommodated and a second tilt chamber closer to a side in which the piston rod is not accommodated by means of a piston fixed to a piston rod, and the tilt device includes a shock blow valve which makes it possible to expand the piston rod by sending oil in the first tilt chamber to the second tilt chamber through a communication hole formed in the piston which is opened and closed with a constant set pressure, wherein the shock blow valve comprises a disk valve fixed to a valve seat surface of the piston, the valve seat surface is provided with a seal member surrounding a communication hole which opens at the valve seat surface, and the disk valve is tightly connected to the seal member;

the piston includes a plurality of communication holes, the tilt device further comprises a single seal member which collectively surrounds all of the communication holes;

a holding groove of the seal member is formed in the valve seat surface of the piston, and the seal member is adhered to the holding groove;

the holding groove formed in the valve seat surface of the piston auxiliary includes a flowing groove for inject-forming the seal member.

3. A tilt device for a marine propulsion unit in which a cylinder device is interposed between a stern bracket fixed to a boat body and a swivel bracket which supports a propulsion unit, the cylinder device is divided into a first tilt chamber closer to a side in which a piston rod is accommodated and a second tilt chamber closer to a side in which the piston rod is not accommodated by means of a piston fixed to a piston rod, and the tilt device includes a shock blow valve which makes it possible to expand the piston rod by sending oil in the first tilt chamber to the second tilt chamber through a communication hole formed in the piston which is opened and closed with a constant set pressure, wherein the shock blow valve comprises a disk valve fixed to a valve seat surface of the piston, the valve seat surface is provided with a seal member surrounding a communication hole which opens at the valve seat surface, and the disk valve is tightly connected to the seal member, the piston includes a plurality of communication holes, the tilt device further comprises a plurality of seal members each of which surrounds each of the communication holes;

a holding groove of the seal member is formed in the valve seat surface of the piston, and the seal member is adhered to the holding groove;

the holding groove formed in the valve seat surface of the piston auxiliary includes a flowing groove for inject-forming the seal member.

* * * * *